US008081127B2

(12) United States Patent
Chen et al.

(10) Patent No.: US 8,081,127 B2
(45) Date of Patent: Dec. 20, 2011

(54) ELECTRONIC DEVICE, ANTENNA THEREOF, AND METHOD OF FORMING THE ANTENNA

(75) Inventors: Yin-Yu Chen, Taipei (TW); Chen-Yu Chou, Taipei (TW); Ming-Feng Tsai, Taipei (TW); Chih-Wei Lee, Taipei (TW)

(73) Assignee: Wistron Corp., Taipei (TW)

( * ) Notice: Subject to any disclaimer, the term of this patent is extended or adjusted under 35 U.S.C. 154(b) by 386 days.

(21) Appl. No.: 12/405,927

(22) Filed: Mar. 17, 2009

(65) Prior Publication Data

US 2009/0315793 A1 Dec. 24, 2009

(30) Foreign Application Priority Data

Jun. 20, 2008 (TW) ..... 97123141 A

(51) Int. Cl.
*H01Q 9/06* (2006.01)
*H01Q 1/22* (2006.01)

(52) U.S. Cl. ..... 343/745; 343/702; 343/749; 343/829; 343/846; 343/850

(58) Field of Classification Search ..... 343/700 MS, 343/702, 749, 829, 830, 846, 745
See application file for complete search history.

(56) References Cited

U.S. PATENT DOCUMENTS

| | | | | |
|---|---|---|---|---|
| 5,912,647 | A * | 6/1999 | Tsuru et al. | 343/700 MS |
| 5,917,450 | A * | 6/1999 | Tsunekawa et al. | 343/700 MS |
| 6,326,927 | B1 * | 12/2001 | Johnson et al. | 343/702 |
| 6,466,170 | B2 * | 10/2002 | Zhou | 343/700 MS |
| 6,714,162 | B1 * | 3/2004 | Kadambi et al. | 343/700 MS |
| 6,864,845 | B2 * | 3/2005 | Kuo et al. | 343/702 |
| 6,933,897 | B2 * | 8/2005 | Asano et al. | 343/702 |
| 7,119,749 | B2 * | 10/2006 | Miyata et al. | 343/702 |
| 7,136,020 | B2 * | 11/2006 | Yamaki | 343/702 |
| 7,589,682 | B1 * | 9/2009 | Wu et al. | 343/702 |
| 2007/0188383 | A1 * | 8/2007 | Onaka et al. | 343/700 MS |
| 2010/0214181 | A1 * | 8/2010 | Ryou et al. | 343/702 |

* cited by examiner

*Primary Examiner* — Douglas W Owens
*Assistant Examiner* — Chuc Tran
(74) *Attorney, Agent, or Firm* — Muncy, Geissler, Olds & Lowe, PLLC

(57) ABSTRACT

The antenna of the invention includes a transceiver unit and a dielectric unit. The transceiver unit has a ground portion, a radial portion, a conductive portion and a feed portion. The ground portion and the radial portion are disposed apart in parallel, so as to form a space therebetween. The distance between the ground portion and the radial portion is defined as a transceiver unit height. The dielectric unit is disposed in the space. That is, the dielectric unit is disposed between the ground portion and the radial portion. The dielectric unit has a dielectric unit thickness less than the transceiver unit height. In one embodiment, the ratio of the dielectric unit thickness to the transceiver unit height is preferably between 0.4 and 0.7.

18 Claims, 6 Drawing Sheets

ELECTRONIC DEVICE, ANTENNA THEREOF, AND METHOD OF FORMING THE ANTENNA

This application claims priority based on a Taiwanese patent application No. 097123141, filed Jun. 20, 2008, the disclosure of which is incorporated herein by reference in its entirety.

BACKGROUND OF THE INVENTION

1. Field of the Invention

The present invention relates to an antenna, an electronic device with the antenna and a manufacturing method of the antenna; particularly, the present invention relates to an antenna with a dielectric unit and an electronic device with the antenna.

2. Description of the Related Art

The mainstream developing tendency of nowadays consumer electronic devices is getting inclined to the features of light weight, thin, short, small size and of smaller in size and multi-function, hence the developing tendency of the composing component of various electronic devices is getting inclined to small size. For instance, the baseband modules and the signal processing modules of nowadays electronic devices can be designed as integrated circuits to reduce the size of electronic devices; however, the size of antennas for electronic devices can not be reduced by circuit integration.

There are many kinds of antennas developed via modern techniques, wherein multipole antennas and monopole antennas are two typical types of antennas. Helical antennas and spiral antennas are the examples of multipole antennas while patch antennas and zigzag antennas are the common examples of monopole antennas. The most common example of monopole antennas is practiced by winding a patch antenna around a substrate made of low temperature co-fired ceramic to form a so-called ceramic antenna for reducing antenna size.

However, subject to the operating frequency of electronic devices, the space for placing ceramic antennas is usually fixed by the logical shape and the size of ceramic antennas and can not be adjusted in accordance with the containing space in electronic devices. The interior design of the composing components of electronic devices is therefore limited and can not be smaller anymore.

SUMMARY OF THE INVENTION

It is an objective of the present invention to provide an antenna with a dielectric unit which can adjust the antenna size according to the receiving/transmitting frequency.

It is another objective of the present invention to provide an electronic device with an antenna which can adjust the antenna size in accordance with the containing space in the electronic device.

It is yet another objective of the present invention to provide a manufacturing method for antennas which has the characteristic of simple and low-cost.

The antenna according to an embodiment of the invention includes a transceiver unit and a dielectric unit. The transceiver unit includes a ground portion, a radial portion, a conductive portion and a feed portion. The parallel distance between the ground portion and the radial portion is defined as a transceiver unit height, in another word, there is a space formed therebetween. The dielectric unit is disposed in the space, i.e., between the ground portion and the radial portion. The dielectric unit has a dielectric unit thickness less than the transceiver unit height. In an embodiment, the ratio of the dielectric unit thickness to transceiver unit height is preferably between about 0.4 and 0.7.

The electronic device according to an embodiment of the invention includes a housing, an antenna and a signal processing circuit board. The antenna is connected with the signal processing circuit board, and disposed within the housing. The antenna includes a transceiver unit and a dielectric unit. The transceiver unit includes a ground portion, a radial portion, a conductive portion and a feed portion. The parallel distance between the ground portion and the radial portion is defined as a transceiver unit height, in another word, there is a space formed therebetween. The dielectric unit is disposed in the space, i.e., between the ground portion and the radial portion. The dielectric unit has a dielectric unit thickness less than the transceiver unit height.

An embodiment of the invention provides a manufacturing method for antennas. To begin with, the method includes a step of forming a transceiver unit which has a ground portion, a radial portion, a conductive portion and a feed portion. The ground portion and the radial portion are disposed apart in parallel with a transceiver unit height to form a space therebetween. The conductive portion is connected between the radial portion and the ground portion. One end of the feed portion is connected to the conductive portion. The method further includes a step of forming a dielectric unit with a dielectric unit thickness which is disposed in the space mentioned above. Furthermore, the method further includes a step of adjusting a ratio of the dielectric unit thickness to the transceiver unit height enabling the radial portion of the transceiver unit to receive/transmit the electromagnetic signals of a predetermined frequency.

DETAILED DESCRIPTION OF THE PREFERRED EMBODIMENT

The present invention provides an antenna, an electronic device using the antenna and the manufacturing method of the antenna. In a more preferred embodiment, the antenna is disposed in a electronic device to receive/transmit wireless signals. In a more preferred embodiment, the electronic device includes Global Positioning System (GPS) device (or an electronic device having the GPS function). However, in different embodiments, the electronic device may also include mobile phones, portable computers or any other devices using antennas to receive/transmit wireless signals.

Figure 1:
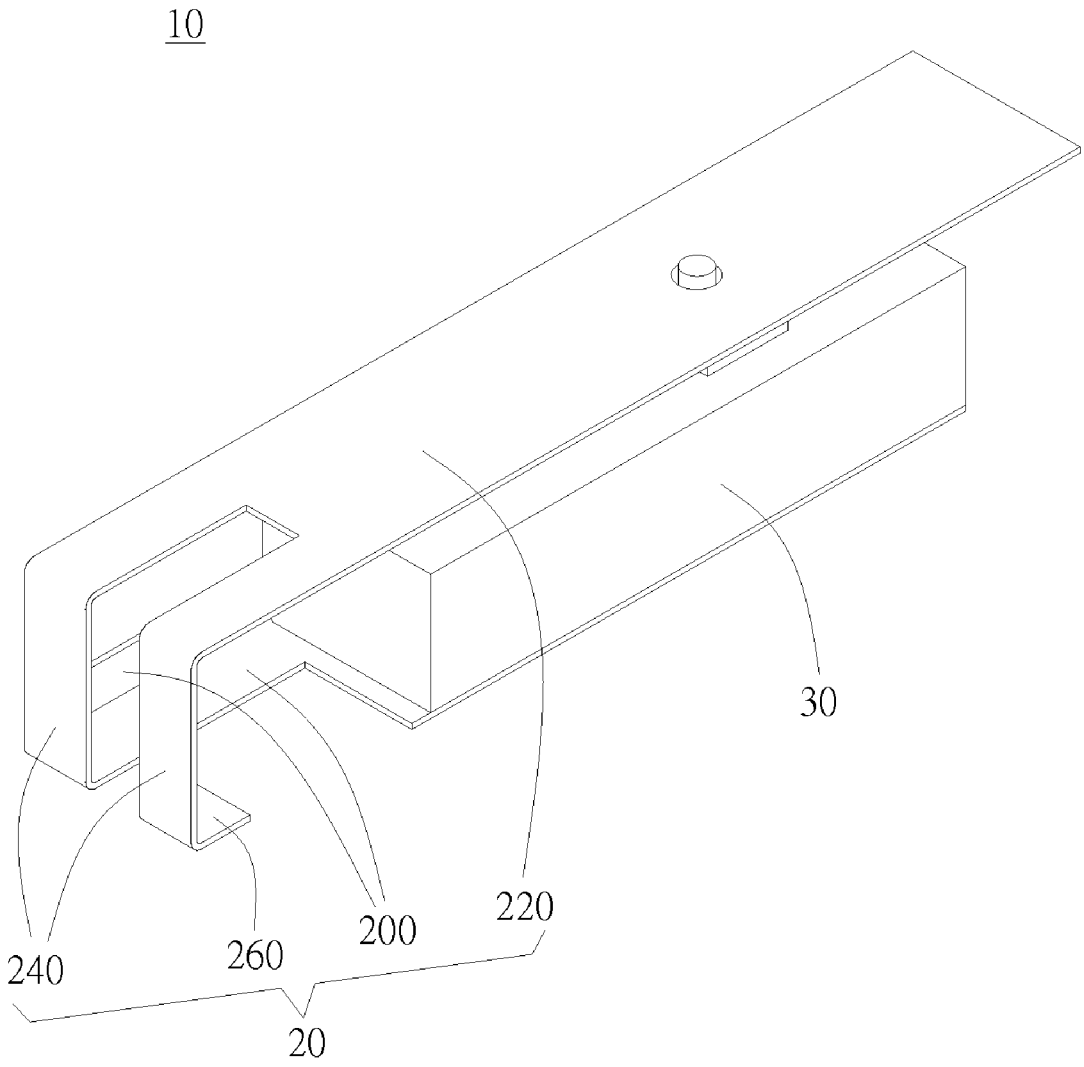
FIG. 1 illustrates a pictorial drawing of the antenna according to an embodiment of the invention.

FIG. 1 illustrates of an embodiment of the antenna of the invention. The antenna 10 includes a transceiver unit 20 and a dielectric unit 30. The transceiver unit 20 is preferably made of metals such as copper but not limited to. The transceiver unit 20 has a long curved slice-shaped structure which serves the function of transmitting and receiving radio frequency electromagnetic signals. Hence, the transceiver unit 20 of the invention can be taken as a patch antenna. The dielectric unit 30 is a non-hollow rectangular lump component which is made of the non-conducting materials with a predetermined permittivity (the value between 3.8 and 4.8 is preferred) such as liquid crystal polymer, plastics or rubbers, etc., which helps the transceiver unit 20 to adjust the resonance frequency and the pattern of electromagnetic signals. As shown in FIG. 1, the transceiver unit 20 and the dielectric unit 30 are disposed in connection with each other as specified below.

Figure 2:
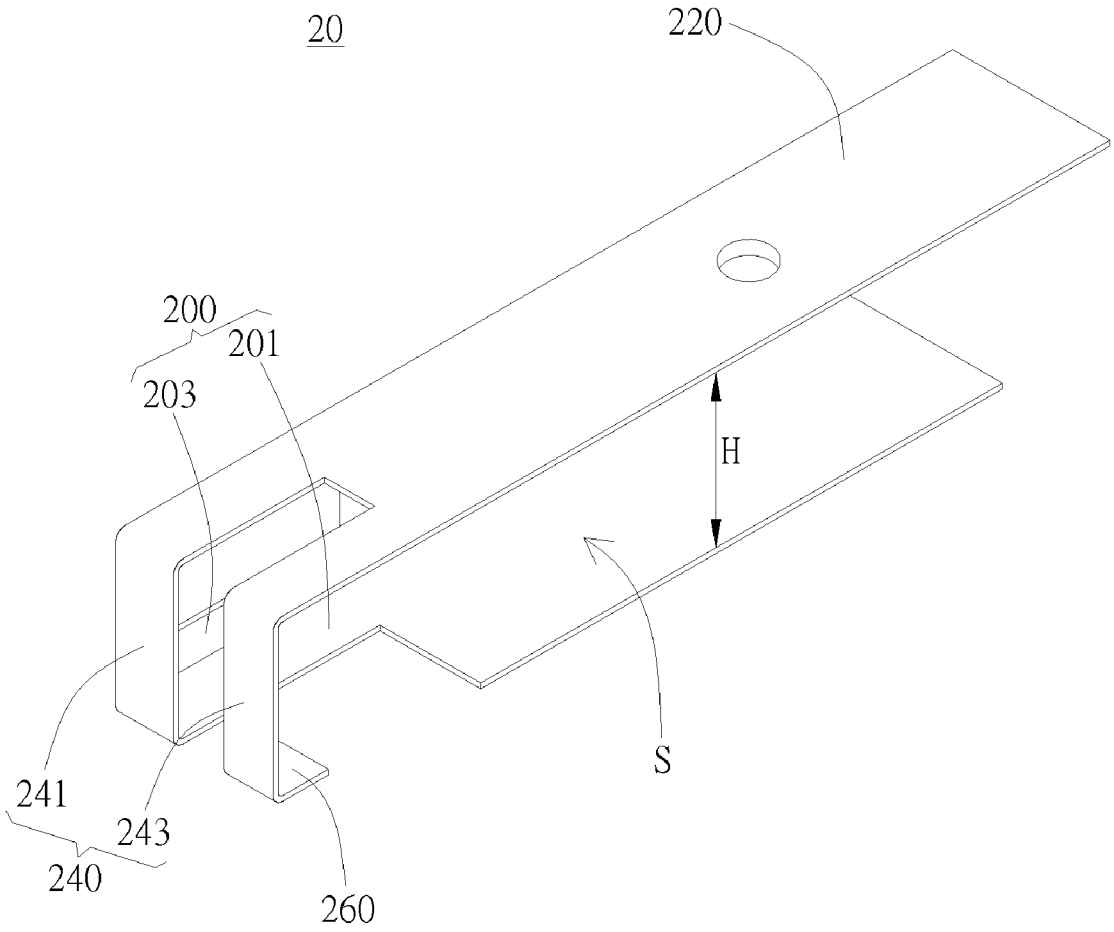
FIG. 2 illustrates a pictorial drawing of the transceiver unit according to an embodiment of the invention.

FIG. 2 illustrates an embodiment of the transceiver unit 20 of the invention. As shown in FIG. 1 and FIG. 2, the transceiver unit 20 includes the following portions: a ground portion 200, a radial portion 220, a conductive portion 240 and a feed portion 260. The ground portion 200 and the radial portion 220 are both long rectangular slice-shaped boards which are disposed in parallel with each other. A space S is formed between the ground portion 200 and the radial portion 220 for accommodating the dielectric unit 30 (as shown in FIG. 1). The distance between the ground portion 200 and the radial portion 220 is defined as a transceiver unit height H. In this embodiment, the ground portion 200 has a first ground surface 201 and a second ground surface 203. The first ground surface 201 is substantially the surface in parallel with the radial portion 220. The second ground surface 203 extends from an edge of the first ground surface 201 toward the radial portion 220 and is vertical to the first ground surface 201. In this embodiment, the purpose of having the first ground surface 201 and the second ground surface 203 is for providing a better grounding to prevent the electromagnetic interference caused by the coupling between the antenna and other electronic components. Hence, the effect of grounding can be adjusted by changing the size (e.g. the height, the width) of the first ground surface 201 and the second ground surface 203. Besides, the second ground surface 203 may be optically disposed. In other embodiments, the ground portion may just have the first ground surface while the second ground surface is omitted, according to demands. For example, if the antenna 10 of this embodiment is for receiving the GPS signals at 1575 Mhz (at the wavelength of 19 cm) frequency, the length of the radial portion 220 of the transceiver unit 20 should be adjusted between about 26 mm and 38 mm while the other portions of the transceiver unit 20 need to be adjusted correspondingly.

Also shown in FIG. 2, two ends of the conductive portion 240 of the transceiver unit 20 are respectively connected with one end of the ground portion 200 and the corresponding end of the radial portion 220. The conductive portion 240 of this embodiment is substantially includes a first electrical conductive section 241 and a second electrical conductive section 243 which are disposed apart in parallel with a space therebetween. Two ends of the first electrical conductive section 241 are connected with the ground portion 200 and the radial portion 220 respectively, which is for transmitting signals between the radial portion 220 and the ground portion 200. One end of the second electrical conductive section 243 is connected to the radial portion 220 while the other end is connected to the feed portion 260. One end of the feed portion 260 is connected to the second electrical conductive section 243 while the other end is kept free and not connected to any portion of the transceiver unit 20; i.e., the free end of the second electrical conductive section 243 is defined as the feed portion 260. The free end of the feed portion 260 is for electrically connecting to the circuit (not figured) which the antenna disposed on. The feed portion 260 feeds in the electromagnetic waves from the signal source of the circuit, and then transmits them by the radial portion 220 through the second electrical conductive section 243. Alternatively, the radial portion 220 receives the electromagnetic waves from outside and then transmitting to the circuit through the feed portion 260 for further processing. In another embodiment, the conductive portion of the invention can also be designed as simply having a conductive section for transmitting signals, hence the design of the conductive portion is not intended to limit the scope of the invention.

Figure 3:
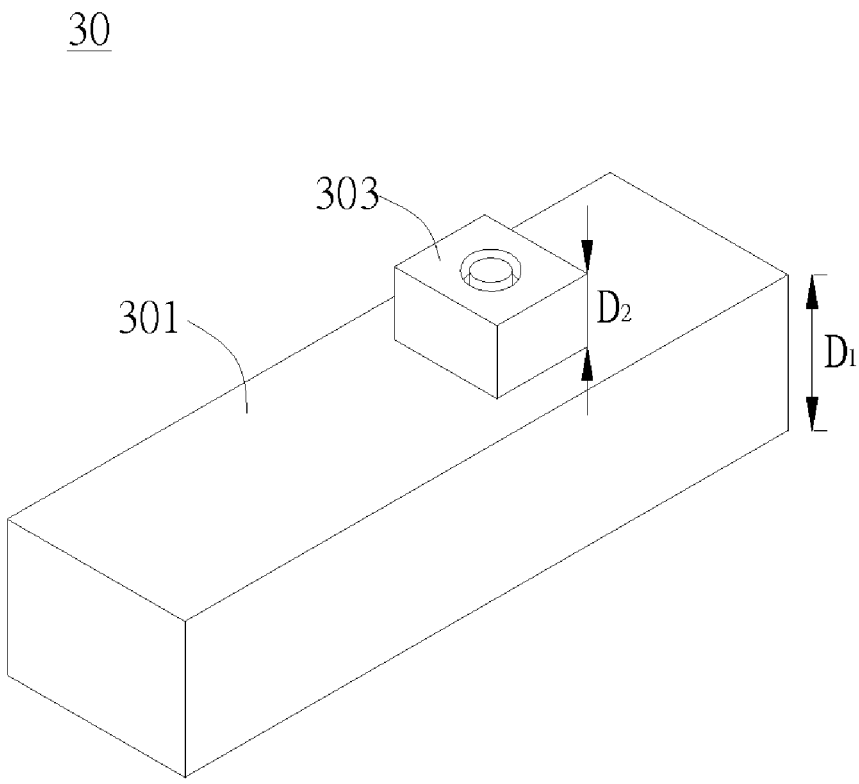
FIG. 3 illustrates a pictorial drawing of the dielectric unit according to an embodiment of the invention.

FIG. 3 illustrates an embodiment of the dielectric unit 30 of the invention. This embodiment uses the non-conducting materials with a predetermined permittivity to make up the dielectric unit 30. A dielectric material with higher permittivity is preferred, such as liquid crystal polymer, plastics or rubber materials. However, in other embodiments, the materials with other permittivity might be adopted. The dielectric unit 30 of this embodiment can be, but not limited to, a non-hollow rectangular lump. The shape of the dielectric unit 30 is preferably designed in accordance with the shape of the transceiver unit 20. As shown in FIG. 3, the dielectric unit 30 has a dielectric unit thickness $D_1$ which is slightly smaller than the transceiver unit height H of the transceiver unit 20. It is preferable to form a lump 303 on the upper surface 301 of the dielectric unit 30 which is in opposition to the radial portion 220 for fixing onto the radial portion 220. In this embodiment, the lump 303 has a lump thickness $D_2$, the sum of the dielectric unit thickness $D_1$ and the lump thickness $D_2$ is about equal to the transceiver unit height H. However, in other embodiments, it is not necessary to form a lump on the dielectric unit and the radial portion may alternatively be fixed onto the transceiver unit by other portions (as specified below).

Figure 4:
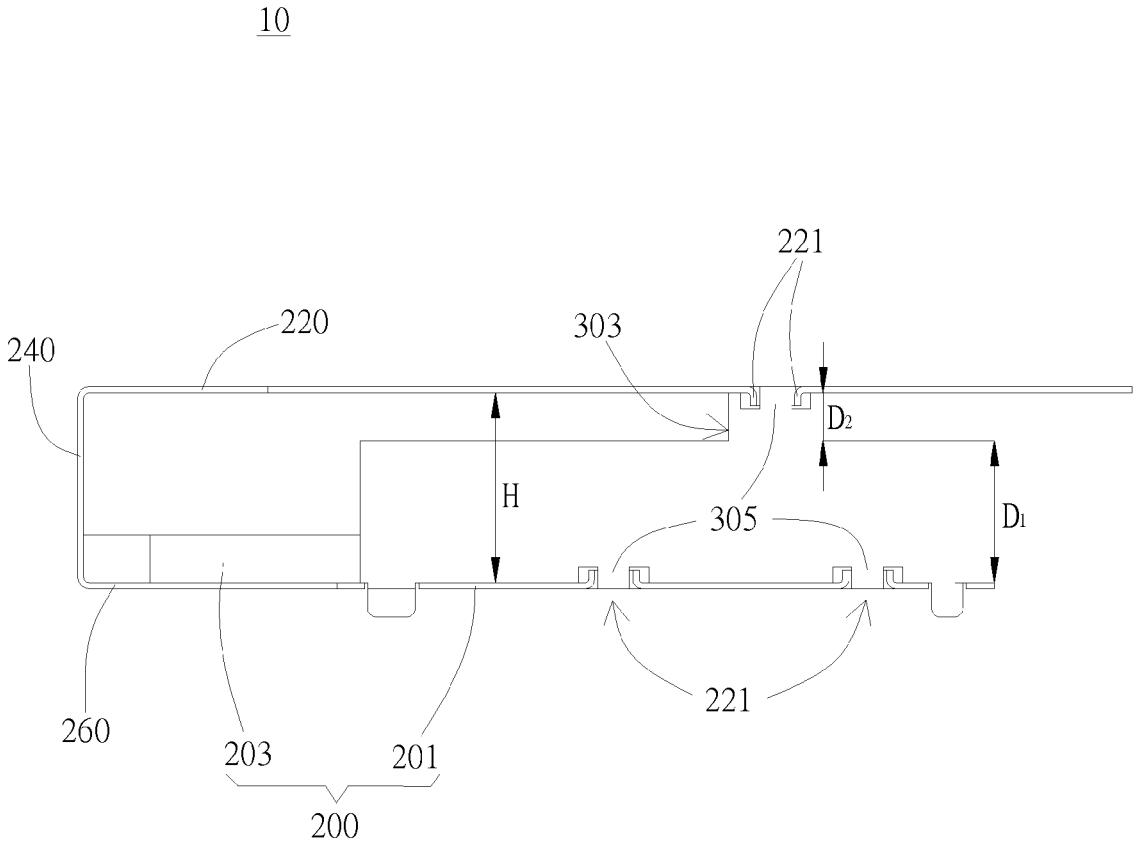
FIG. 4 illustrates a side view of the antenna according to an embodiment of the invention.

FIG. 4 illustrates a side view of an embodiment of the antenna 10 of the invention. As shown in FIG. 4, the bottom of the dielectric unit 30 of this embodiment has a plurality of first joint portions 305 (two first joint portions 305 are provided in this embodiment), such as circular grooves. The ground portion 200 of the transceiver unit 20 has a second joint portion 221 which is corresponding to the first joint portion 305. The first joint portion 305 and the second joint portion 221 are fixed onto each other. The second joint portion 221 of this embodiment can be a circular cam which is hollowed out in the middle portion for plugging into the circular groove for the purpose of fixing. In this embodiment, the lump 303 on the dielectric unit 30 also has a first joint portion 305, and the corresponding portion of the radial portion 220 also has a second joint portion 221. The first joint portion 305 of this embodiment is also a circular groove while the second joint portion 221 is also a circular cam which is hollowed out in the middle portion. The two portions are disposed by joining to each other. However, in other embodiments, the shape of the first joint portion 305 and the second joint portion 221, the position of the first joint portion 305 on the dielectric unit 30, and the position of the second joint portion 221 on the ground portion 200 are not limited to the above expression. Other designs are possible, but the positions and the shapes of the first joint portion 305 and the second joint portion 221 should be correspondingly designed so as to fix the dielectric unit 30 and the transceiver unit 20 onto each other by the joint portions.

Also shown in FIG. 4, the size of the dielectric unit 30 is designed n accordance with the size of the transceiver unit 20. At first, the sum of the dielectric unit thickness $D_1$ and the lump thickness $D_2$ is about equal to the transceiver unit height H. It is to be noted that the ratio of the dielectric unit thickness $D_1$ of the dielectric unit 30 to the transceiver unit height H of the transceiver unit 20 is preferably between 0.4 and 0.7.

Figure 5:
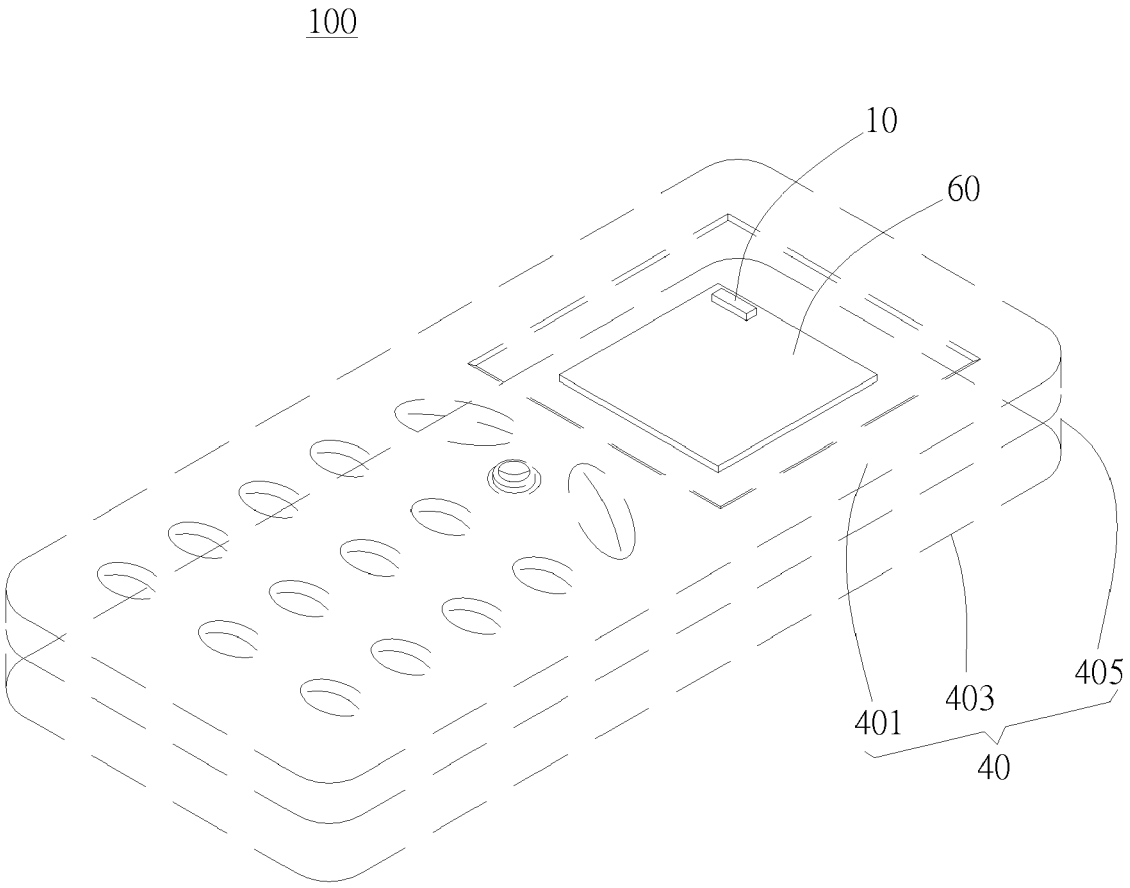
FIG. 5 illustrates a schematic view of an electronic device with the antenna of the invention.

FIG. 5 illustrates an electronic device 100 with the antenna 10 of the invention. The electronic device 100 of the invention is a device receiving/transmitting electromagnetic signals through antennas, such as mobile phones. The electronic device 100 includes an antenna 10, a housing 40 and a signal processing circuit board 60. Other necessary components of general electronic devices (e.g., CPU, monitor) will not be specified here. The structure of the antenna 10 is the same as the antenna described in the embodiment above and not elaborated in detail again. FIG. 5 mainly schematically shows the correlated position of the antenna 10 in the electronic device 100. The antenna 10 and the signal processing circuit board 60 are disposed in the housing 40. The feed portion 260 of the antenna 10 is connected to the signal processing circuit board 60 for receiving feed-in signals. As shown in FIG. 5, the housing 40 includes a front cover 401, a back cover 403 and a side cover 405. The front cover 401 and the back cover 403 are parallel with each other. The side cover 405 is vertically connected with the front cover 401 and the back cover 403. Above all, the antenna 10 of this embodiment is disposed near to the corner where the back cover 403 and the side cover 405 are connected with each other. Preferably, the antenna 10 and the side cover 405 keep a distance substantially equal to ¼ wavelength (or a multiple of it) away from each other for the antenna to have a better impedance matching. The wavelength mentioned above is the wavelength of the electromagnetic signals received/transmitted by the antenna 10. The arrangement of the antenna 10 enables the completeness of antenna pattern when the electromagnetic signals are transmitted by the antenna 10 of the electronic device 100. Moreover, because the antenna 10 is on the corner of electronic device 100, the arrangement of the antenna 10 of this embodiment can reduce the effects upon user's brain caused by Specific Absorption Rate (SAR) when a user holds the electronic device 100.

Figure 6:
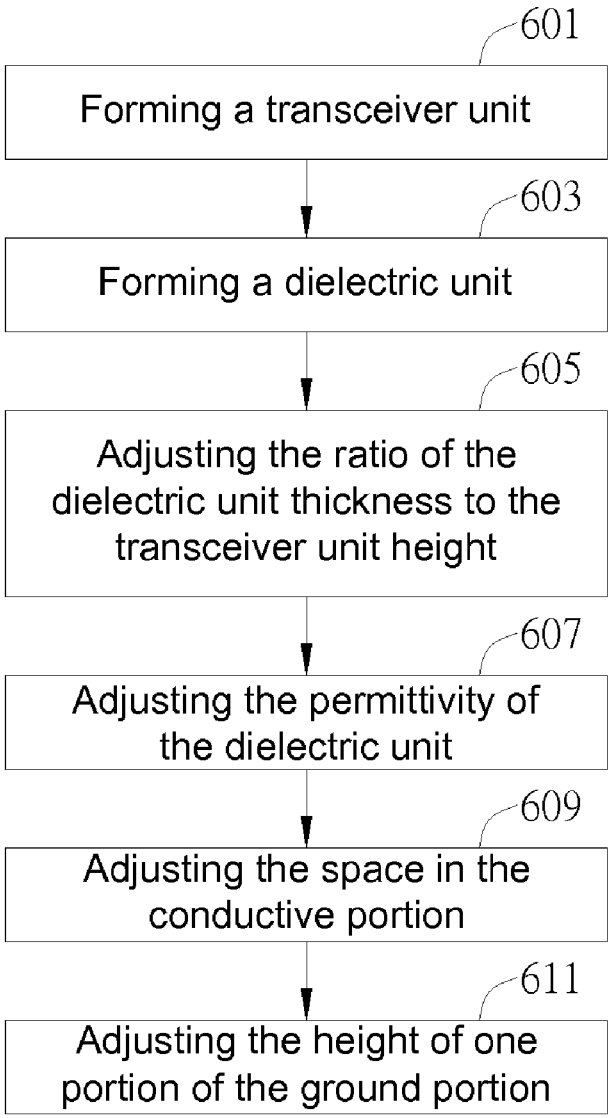
FIG. 6 illustrates a flow chart of the procedure for forming an antenna according to an embodiment of the invention.

FIG. 6 illustrates a flow chart of the procedure for forming an antenna according to an embodiment of the invention. First of all, a transceiver unit is formed in step 601. The transceiver unit includes a ground portion, a radial portion, a conductive portion and a feed portion. The ground portion and the radial portion are disposed apart in parallel so that a space is formed therebetween, and a distance equal to the transceiver unit height is kept between the ground portion and the radial portion. Two ends of one portion of the electrical conductive portion are connected between the radial portion and the ground portion respectively. One end of the other portion of the electrical conductive portion is connected to the radial portion while the other end is connected to the feed portion. Moreover, a dielectric unit is formed in step 603. The dielectric unit is disposed in the space formed between the ground portion and the radial portion of the transceiver unit. The dielectric unit is preferably connected with the ground portion and the radial portion, but in other embodiments, it can be selectively connected to one of the ground portion and the radial portion. The dielectric unit has a dielectric unit thickness which is smaller than the transceiver unit height. Adjusting a ratio of the dielectric unit thickness to the transceiver unit height is performed in step 605 so that the frequency response of the radial portion of the transceiver unit corresponds to the electromagnetic signals of a predetermined frequency. In a more preferred embodiment, the step 605 includes adjusting the ratio of the dielectric unit thickness to the transceiver unit height to between 0.4:1 and 0.7:1. In other words, the ratio of the dielectric unit thickness to the transceiver unit height is preferably between 0.4 and 0.7.

The method further includes step 607 of adjusting the permittivity of the dielectric unit, the permittivity of the embodiment is adjusted preferably between 3.8 and 4.8. The step can be performed by changing the dielectric material for making the dielectric unit. The materials for making dielectric units are generally non-conducting materials with a higher permittivity, such as liquid crystal polymer or plastics. The size (i.e., the height, the length or the width) of the transceiver unit can be varied by adopting a material having different permittivity, according to design requirements. The step 609 of adjusting the space in the conductive portion can be further included. To be more exactly, when forming the transceiver unit of the invention, the conductive portion therein has a first electrical conductive section and a second electrical conductive section which are disposed apart with a space therebetween. Two ends of the first electrical conductive section are connected with the radial portion and the ground portion respectively. Two ends of the second electrical conductive section are connected to the radial portion and the feed portion respectively. The impedance matching of the antenna is adjusted by adjusting the space between the two electrical conductive sections, thereby obtaining a better frequency response. This embodiment further includes step 611 of adjusting the height of one portion of the ground portion. The ground portion of the transceiver unit of this embodiment has a first ground surface and a second ground surface. The first ground surface is the surface in parallel with the radial portion. The second ground surface extends from an edge of the first ground surface toward the radial portion and is vertical to the first ground surface. The impedance matching of the antenna can be adjusted with the help of adjusting the height of the second ground surface. It is to be noted that the steps 607, 609 and 611 mentioned above may optionally practiced. The order of practicing the steps is not limited to the embodiment and can be changed in accordance with different embodiments.

Although the present invention has been described through the related embodiments mentioned above, the embodiments mentioned above are merely the examples for practicing the present invention. What need to be indicated is that the disclosed embodiments are not intended to limit the scope of the present invention. On the contrary, the modifications within the essence and the scope of the claims and their equivalent dispositions are all contained in the scope of the present invention.

What is claimed is:

1. An antenna, comprising:

a transceiver unit for transmitting and receiving electromagnetic signals, wherein said transceiver unit includes:

a ground portion;

a radial portion disposed in parallel with said ground portion and apart from said ground portion with a transceiver unit height to form a space therebetween;

a conductive portion at least partially connected with one end of said radial portion and one end of said ground portion, said conductive portion including a first electrical conductive section and a second electrical conductive section, wherein both the first electrical conductive section and said second electrical conductive section have bent parts that are spaced apart by an interval; and a feed portion connected with said conductive portion and parallel with said radial portion, one of said first electrical conductive section and said second electrical conductive section is connected to said feed portion; and a dielectric unit disposed in the space formed between said ground portion and said radial portion and connected with said ground portion, wherein said dielectric unit has a dielectric unit thickness less than said transceiver unit height; wherein said dielectric unit has an upper surface including a lump for fixing said dielectric unit on said radial portion, said lump has a lump thickness, the sum of said lump thickness and said dielectric unit thickness is substantially equal to said transceiver unit height.

2. The antenna of claim 1, wherein the ratio of said dielectric unit thickness to said transceiver unit height is substantially between 0.4 and 0.7.

3. The antenna of claim 1, wherein a first joint portion is formed on said lump, a second joint portion is formed on said radial portion, said first joint portion couples with second joint portion to connect said radial portion with said dielectric unit.

4. The antenna of claim 1, wherein said a first electrical conductive section has two ends respectively connected to said ground portion and said radial portion;

said second electrical conductive section is in parallel with said first electrical conductive section to form said interval therebetween, two ends of said second electrical conductive section are respectively connected to said radial portion and said feed portion.

5. The antenna of claim 4, wherein one end of said feed portion is connected with said second electrical conductive section while the other end of said feed portion is a free-end.

6. The antenna of claim 1, wherein said ground portion has a first ground surface and a second ground surface, said first ground surface is parallel with said radial portion, said second ground surface vertically extends from an edge of said first ground surface toward said radial portion.

7. The antenna of claim 6, wherein said dielectric unit is disposed close to said first ground surface and said second ground surface.

8. The antenna of claim 7, wherein said dielectric unit has at least one first joint portion, said first ground surface has at least one second joint portion, said first joint portion is connected with said second joint portion.

9. The antenna of claim 1, wherein the material of said dielectric unit includes polymer liquid crystals or plastics.

10. The antenna of claim 1, wherein the material of said transceiver unit includes metals.

11. An electronic device, comprising:

a housing;

an antenna disposed within said housing, wherein said antenna includes:

a transceiver unit for transmitting and receiving electromagnetic signals, wherein said transceiver unit includes:

a ground portion;

a radial portion disposed in parallel with said ground portion and apart from said ground portion with a transceiver unit height to form a space therebetween;

a conductive portion connected with one end of said radial portion and one end of said ground portion, said conductive portion including a first electrical conductive section and a second electrical conductive section, wherein both of said first electrical conductive section and said second electrical conductive section have bent parts that are spaced apart by an interval; and a feed portion connected with said conductive portion and parallel with said radial portion, one of said first electrical conductive section and said second electrical conductive section is connected to said feed portion; and a dielectric unit disposed in the space formed between said ground portion and said radial portion and connected with said ground portion, wherein said dielectric unit has a dielectric unit thickness less than said transceiver unit height; and said dielectric unit has an upper surface, whereupon there is a lump, said lump has a lump thickness and the sum of said lump thickness and said dielectric unit thickness is about equal to said transceiver unit height;

a signal processing circuit board electrically connected to said antenna, said signal processing circuit board processing electromagnetic signals.

12. The electronic device of claim 11, wherein said housing includes a front cover, a back cover, and a side cover, said front cover is parallel with said back cover, said side cover is vertically connected with said front cover and said back cover, wherein said antenna is disposed in a corner near to said back cover and said side cover.

13. The electronic device of claim 12 wherein a distance between said antenna and said side cover substantially equals to ¼ wavelength of said electromagnetic signal.

14. The electronic device of claim 11 wherein a ratio of said dielectric unit thickness to said transceiver unit height is substantially between 0.4 and 0.7.

15. The electronic device of claim 11, wherein said first electrical conductive section has two ends respectively connected with said ground portion and said radial portion;

said second electrical conductive section is at least partly in parallel with said first electrical conductive section and keeping said interval therebetween, two ends of said second electrical conductive section respectively connected with said radial portion and said feed portion.

16. The electronic device of claim 11, wherein said ground portion of said antenna has a first ground surface and a second ground surface, said first ground surface is parallel with said radial portion, said second ground surface extends vertically from an edge of said first ground surface toward said radial portion.

17. A method for manufacturing an antenna, comprising:

forming a transceiver unit, said transceiver unit including a ground portion, a radial portion, a conductive portion and a feed portion, said ground portion and said radial portion disposed in parallel with each other and apart from each other with a transceiver unit height to form a space therebetween, said conductive portion connected between said radial portion and said ground portion, and one end of said feed portion connected to said conductive portion;

disposing a dielectric unit in the space formed by said ground portion and said radial portion to connect with said ground portion, wherein said dielectric unit has a dielectric unit thickness; and adjusting a ratio of the dielectric unit thickness to said transceiver unit height enabling said radial portion of said transceiver unit to receive or transmit electromagnetic signals of a predetermined frequency.

18. The method of claim 17, further comprising adjusting a ratio of the dielectric unit thickness to said transceiver unit height to substantially limit the ratio of said dielectric unit thickness to said transceiver unit height within the range between 0.4 and 0.7.

* * * * *